US006305535B1

(12) United States Patent
Fair

(10) Patent No.: US 6,305,535 B1
(45) Date of Patent: Oct. 23, 2001

(54) ADJUSTABLE HANDLE FOR GOLF BAGS

(75) Inventor: Paul Fair, Denver, CO (US)

(73) Assignee: Dancorp Investors, Inc., Macedon, NY (US)

( * ) Notice: Subject to any disclaimer, the term of this patent is extended or adjusted under 35 U.S.C. 154(b) by 0 days.

(21) Appl. No.: 09/657,898

(22) Filed: Sep. 8, 2000

(51) Int. Cl.[7] ..... A63B 55/00

(52) U.S. Cl. ..... 206/315.3; 224/627; 224/645; D3/255; D3/327

(58) Field of Search ..... 224/627, 645; 206/315.3; D3/255, 327

(56) References Cited

U.S. PATENT DOCUMENTS

| | | | | |
|---|---|---|---|---|
| 5,038,984 | * | 8/1991 | Izzo | 224/645 |
| 5,042,703 | * | 8/1991 | Izzo | 224/645 |
| 5,042,704 | * | 8/1991 | Izzo | 224/645 |
| 5,390,788 | * | 2/1995 | Schenkkan | 224/645 |
| 5,593,077 | * | 1/1997 | Izzo | 224/627 |
| 6,131,783 | * | 10/2000 | Maeng | 224/645 |
| 6,152,343 | * | 11/2000 | Shin | 224/645 |

* cited by examiner

*Primary Examiner*—Stephen P. Garbe
(74) *Attorney, Agent, or Firm*—Neal L. Slifkin; Harris Beach LLP

(57) ABSTRACT

An improved golf bag handle assembly is provided to mount dual shoulder straps to a golf bag. The golf bag has a handle which is located on the sidewall of the bag. The central portion of the dual shoulder strap assembly is designed to be mounted to a unique handle casing which is slidably disposed on the existing golf bag handle. The strap assembly includes a mounting web connected to the central mounting element. The handle casing includes a handle portion and an attachment member or ring integral with the handle portion. The mounting web links the central mounting element to the attachment ring. The handle casing includes an internal channel adapted to accept the handle of the golf bag. The handle casing position may be adjusted such that the weight distribution between the user's shoulders may be adjusted. To adjust the handle casing position, the handle preferably includes a locking lever which is rotated between a locked position in which the handle casing is fixed in position and an unlocked position in which the handle casing may be slid to the desired position on the golf bag's handle. The location of this attachment can be at a selected place axially along the handle to define the primary balance point for carrying the golf bag.

12 Claims, 6 Drawing Sheets

ADJUSTABLE HANDLE FOR GOLF BAGS

FIELD OF INVENTION

The present invention relates to golf bags and, more particularly, to apparatus used in conjunction with golf bags to facilitate transport thereof by a person. Specifically, the present invention is directed to a handle for use with a dual strap golf bag carrying device whereby a person may carry a golf bag either with a pair of straps placed across both shoulders and with the golf bag resting against his/her back or with a single strap in the traditional manner.

BACKGROUND OF THE INVENTION

The game of golf is one of the most widely enjoyed sports activities in the world. The number of persons participating in this activity, both at the professional and recreational level, is almost unparalleled. Not only is this activity already widespread, but also the ranks of golfers continue to swell.

The sport of golf is typically played on a course consisting of nine or eighteen holes. A set of clubs is used to strike a golf ball along each hole comprising the course. Each hole consists of a tee box which defines a starting location wherein a golfer places a ball and initially strikes the ball towards a green. Each green includes a recessed cup, and it is the object of the golfer to strike the ball with a series of strokes into the cup. Different clubs are used to vary the height, distance and spin of the ball. The holes normally vary in length from short holes of approximately one hundred yards to longer holes of five hundred yards and greater. The holes are flanked by rough areas out of which it is more difficult to play, and hazards are provided to increase the intricacy and precision required in play.

Golfers may travel over a course during play in a variety of manners. For example, a golfer may walk a course and carry his/her clubs or sometimes employs another to carry clubs for him/her. Other golfers employ wheeled pull carts which receive a set of clubs so that a golfer may push or pull the cart as the golfer walks each hole. Motorized or engine driven carts are available at some courses and, in fact, are required for play at certain courses. Here, a golfer mounts his/her clubs on the motorized cart and drives across the course from ball lie to ball lie.

The present invention concerns those persons who walk a golf course and carry their own golf bag and clubs. This invention is thus useful for a substantial number of golfers who desire walking a golf course as a means of a healthy, enjoyable exercise. One of the drawbacks which has long existed for these golfers prior to the present invention, however, is the nature of the construction of the standard golf bag. Here, the typical golf bag which receives the set of clubs is in the form of a tubular carrying member enclosed at one end so that the shafts of the clubs may be longitudinally received in the bag. A single strap extends from an upper rim of the golf bag to a mid-point on the bag. The golfer or the caddy then carries such bag by inserting one arm through the strap so that the strap extends across one shoulder thus supporting the bag for travel. A small handle may also be mounted on the bag, normally between the end points of the strap, to enable the bag to be carried by the human hand.

A disadvantage to this system has long been present, though, and is readily realized by persons who carry golf bags over a golf course. This problem results from the fact that the entire weight of the golf clubs and bag, which may typically be on the order of twenty to twenty-eight pounds, strains the muscles of the neck and shoulders unduly and further causes muscular strain resulting from the imbalanced nature of this method of carriage. Indeed, the imbalance can cause associated muscle soreness in the hips and lower back due to the fact that the center of gravity of the bag is offset with respect to the spine. This is of particular concern to those golfers who experience back problems.

Recently, a carrying system has been developed that can be manufactured both by original equipment on a golf bag and which can be retrofited onto standard golf bags. This carriage system is simple to use and enhances the game of golf for those who normally carry their golf bags. U.S. Pat. Nos. 5,038,984, 5,042,703 and 5,042,704, all issued to Izzo, the disclosures of which are incorporated by reference herein, relate to this recently developed golf bag carrying system. The system allows the user to comfortably carry the golf bag such that it is centered on the back of the wearer and so that the weight of the golf bag is equally distributed between both shoulders of the wearer. The present invention provides an improvement on this dual strap carrying system.

SUMMARY OF THE INVENTION

An object of the present invention is to provide an improved strap assembly for carrying golf bags which may be employed as a retro-fit system or combined with the construction of a golf bag when it is originally produced.

A further object of the present invention is to provide a dual strap system to allow a golf bag to be centered on the back of a human carrier.

Yet another object of the present invention is to provide a dual strap golf bag carrying device wherein the weight of a golf bag may be simultaneously supported by both shoulders of the golf bag carrier, or alternately may be carried by a single strap on one shoulder, if desired, in the traditional manner.

A still further object of the present invention is to provide a dual strap carrying device for golf bags that is easy and convenient to use and is more comfortable for the carrier of a set of golf clubs.

A further object of the present invention is to provide a dual strap carrying device for golf bags which allows the golf bag to be carried at a higher point on the user's back than such carrying systems of the past.

According to the present invention, a golf bag carrying system is provided in the form of a dual strap carrying device that may be manufactured either in conjunction with the construction of a golf bag, as original equipment, or which may be manufactured as a retro-fit system attachable to a standard golf bag assembly. The dual strap carrying device may also be used on other carrying cases such as luggage, business cases, backpacks, computer cases and musical instrument cases. When used with golf bags, in its broad form, the present invention is in the form of a strap assembly for use with a golf bag wherein the golf bag is in the form of an elongated tubular member having a surrounding sidewall, an enclosed end and an open end whereby the shafts of golf clubs made be inserted into the golf bag. The strap assembly includes a first strap having a first strap end secured to the golf bag at a first location proximate the open end and having a first strap second end secured to the golf bag at a second location axially spaced from the first location along an attachment axis. The first strap thereby defines a primary strap forming a first strap opening which may be secured over one of the person's shoulders. The second strap has a second strap first end secured to the golf bag proximate the second location and has a second strap second end secured to the golf bag at a third location axially spaced from the second location along the attachment axis between the second location and the closed end of the golf bag thereby defining a second strap opening. The second strap thus forms a secondary strap which may be positioned over the other shoulder of the person so that the golf bag may be suspended from and supported by both shoulders in a fully supported state. In the fully supported state, therefore, the golf bag is oriented transversely across the back of the wearer.

Preferably, the first strap second end and second strap first end are fastened adjacent one another to form a central portion which is secured to the golf bag at the second location. The strap ends, are connected to a central mounting element. The central mounting element could be constructed in a variety of shapes and from a variety of materials. This central mounting element is further connected to the golf bag handle assembly.

The golf bag handle is located on the sidewall and extends axially between the first and third locations. The central portion of the strap assembly is designed to be mounted to a unique handle casing which is slidably disposed on the existing golf bag handle. The handle casing is preferably made of a polymer such as acetel or nylon 6, although other materials are possible. The strap assembly includes a mounting web connected to the central mounting element. The handle casing includes a handle portion and an attachment member or ring integral with the handle portion. The mounting web links the central mounting element to the attachment member. The handle casing includes an internal channel adapted to accept the handle of the golf bag. A typical golf bag handle is made from webbing which is three quarters of an inch wide. The internal channel is designed to accept this standard golf bag handle. The handle casing position may be adjusted such that the weight distribution between the user's shoulders may be adjusted. To adjust the handle casing position, the handle preferably includes a locking lever which is rotated between a locked position in which the handle casing is fixed in position and an unlocked position in which the handle casing may be slid to the desired position on the golf bag's handle. The locking lever preferably includes teeth which hold the handle casing in position with respect to the handle. However, one skilled in the art will recognize that other means for holding the handle casing in place will work such as a cam, roller, belt buckle mechanism or other suitable fixing mechanisms. The handle defines the second location for attachment of the strap assembly to the golf bag. The location of this attachment can be at a selected place axially along the handle to define the primary balance point for carrying the golf bag.

The first strap first end may include a first releasable mounting means, such as a swivel clip, and the second strap second end may include a second releasable mounting means such as a second mounting clip, so that the ends of the strap assembly opposite the central portion may be releasably attachable to the golf bag respectively at the first and third locations. Further, the first and second straps may include adjustment elements for adjusting their respective effective lengths, and the first and second straps may be provided with pads operative as cushions on the persons shoulders.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a golf bag assembly that uses a strap assembly enabling a golfer to conveniently carry a golf bag on both shoulders, although the structure described allows carriage of the golf bag on a single shoulder as well. The present invention is designed to be used with either a strapping assembly that may be manufactured as original equipment on a golf bag or which may be manufactured separately as a retro-fit attachment to existing golf bags. In either case, the strap assembly includes a pair of straps which are connected to and oriented longitudinally along a golf bag to define an attachment axis. A first strap has a first strap first end connected to an upper portion of the golf bag and a first strap second end connected to a mid-portion of the golf bag that is longitudinally spaced from the upper portion. The second strap has a second strap first end that is connected to the mid-portion of the golf bag proximate to the location of the attachment point of the first strap second end. The second strap has a second strap second end that is connected to a lower portion of the golf bag longitudinally spaced from the mid-portion. These straps may then be mounted over the left and right shoulders of a person who is to carry the golf bag so that the weight of the golf bag is suspended from both of the person's shoulders to hang in an orientation across the person's back.

Figure 1:
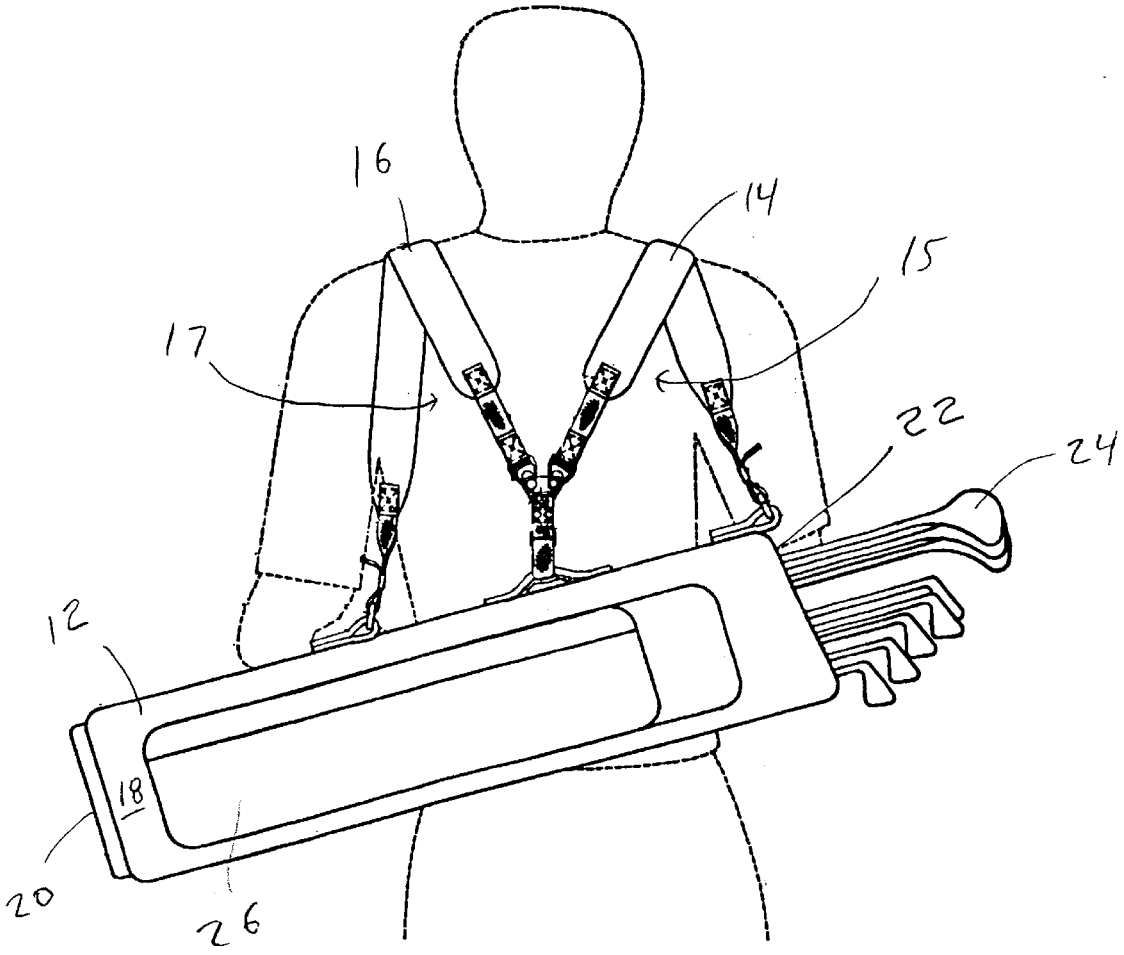
FIG. 1 (PRIOR ART)
FIG. 1 is a perspective rear view of a person carrying a golf bag utilizing the prior art strap assembly with the golf bag shown in a fully supported state for a right hand orientation.
Figure 2:
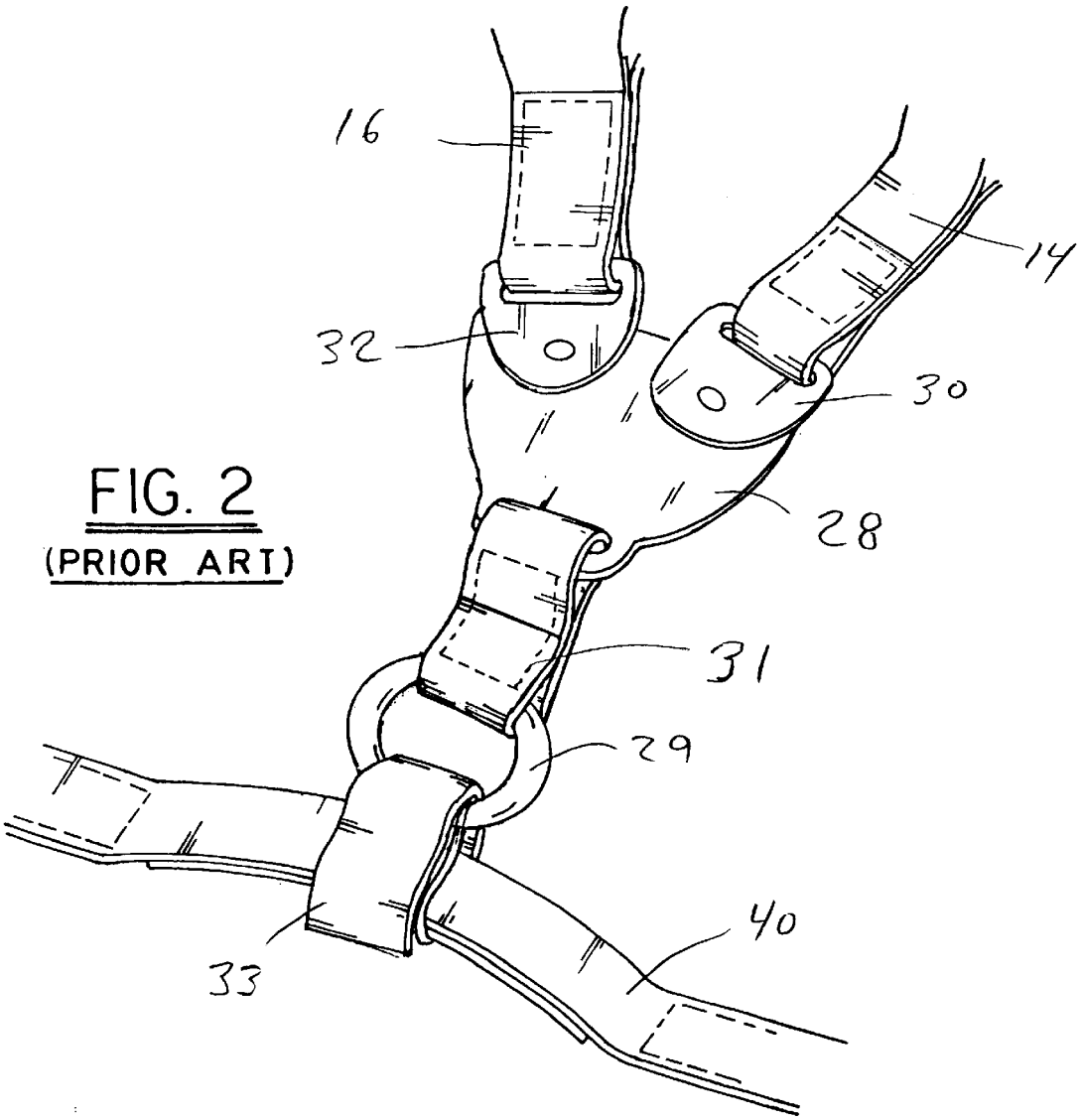
FIG. 2 (PRIOR ART)
FIG. 2 is a perspective view of the prior art attachment assembly.

FIGS. 1 and 2 show the prior art carrying system. In FIG. 1, for illustration purposes, it is seen that a person carries a golf bag 12 in a fully supported state by a first strap 14 and a second strap 16. Golf bag 12 is in the form of an elongated tubular body having a surrounding sidewall 18, a closed end 20 and an open end 22 so that set of golf clubs 24 may be inserted in golf bag 12 for storage and transport. Auxiliary compartments 26 are provided to permit transport of auxiliary golf equipment and are oriented to permit balancing of the weight of the golf bag and clubs.

FIG. 2 shows the prior art attachment assembly in greater detail. The shoulder straps 14 and 16 are connected to the central mounting element 28 by swivel attachments 30 and 32 at one end. At the other end of the central mounting element 28, a strap 31 connects the central mounting element 28 to a ring 29. The ring 29 is attached to the handle 40 of the golf bag 12 by another strap 33. While this attachment assembly works well, the distance between the straps 14 and 16 and the golf bag 12 is relatively large, causing the golf bag to be lower on the wearer's back than is desirable. The present invention allows the golf bag 12 to be positioned two to five inches higher on the wearer's back compared to the prior art design of FIG. 1. This results in a significant increase in comfort to the wearer.

The golf bag structure implementing the present invention is shown in FIGS. 3–7. In these figures, it may be seen that golf bag 12 has a central handle 40 located at a mid-portion of golf bag 12. First strap 14 defines a primary strap and has a first strap first end 52 which is secured to golf bag 12 at a first location along an upper end portion 34 adjacent open end 22. A second end 54 of first strap 14 is secured to golf bag 12 at a second location along a mid-portion thereof, and second end 54 is secured to handle assembly as described below. Second strap 16 has a first end 56 secured to a mid-portion of golf bag 12, specifically to the handle assembly, and second strap 16 has a second end 58 secured to golf bag 12 at a third location longitudinally spaced from the point of attachment of ends 54 and 56 toward a lower portion of golf bag 12.

Figure 4:
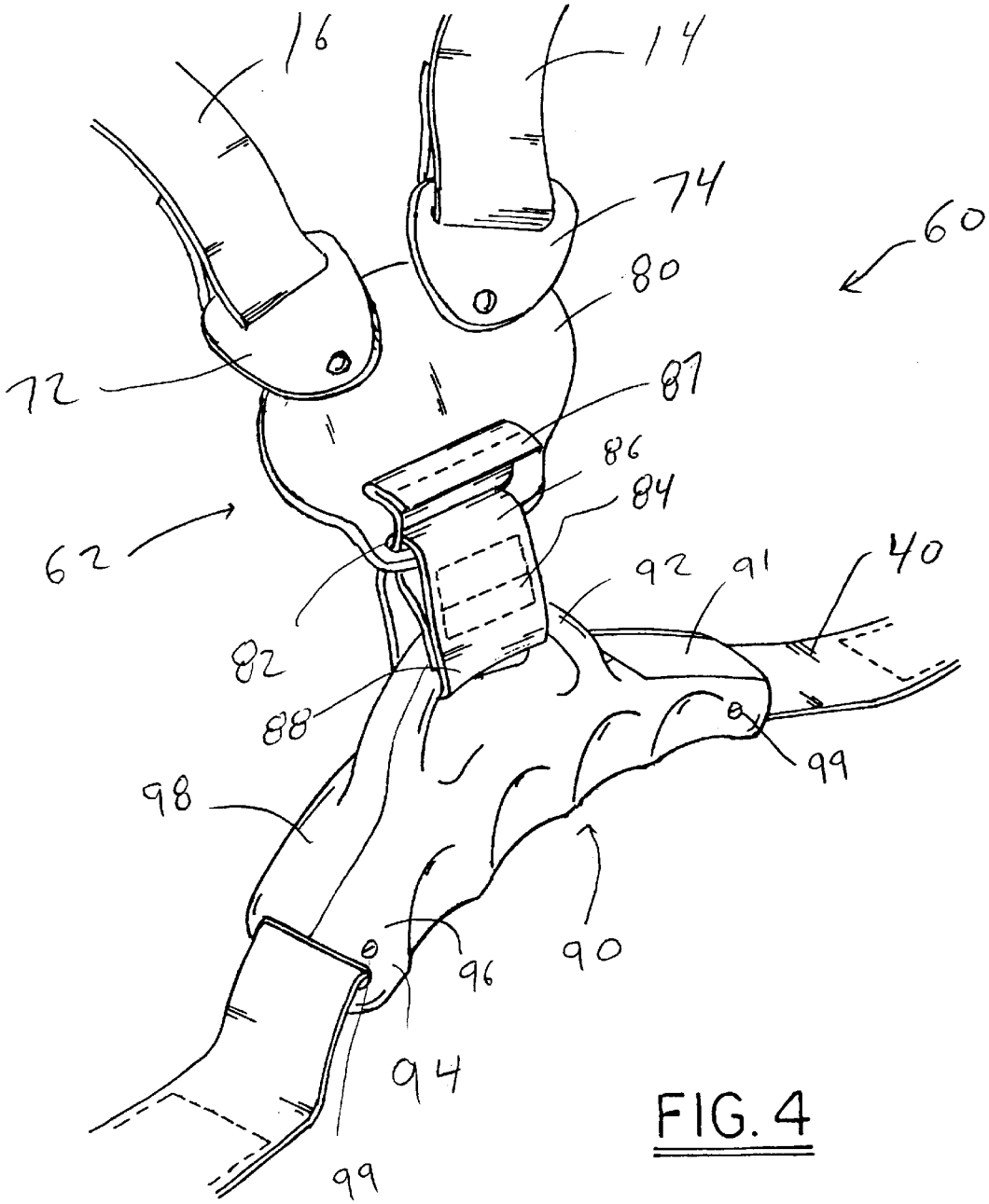
FIG. 4 is a perspective view of one embodiment of the present invention.
Figure 5:
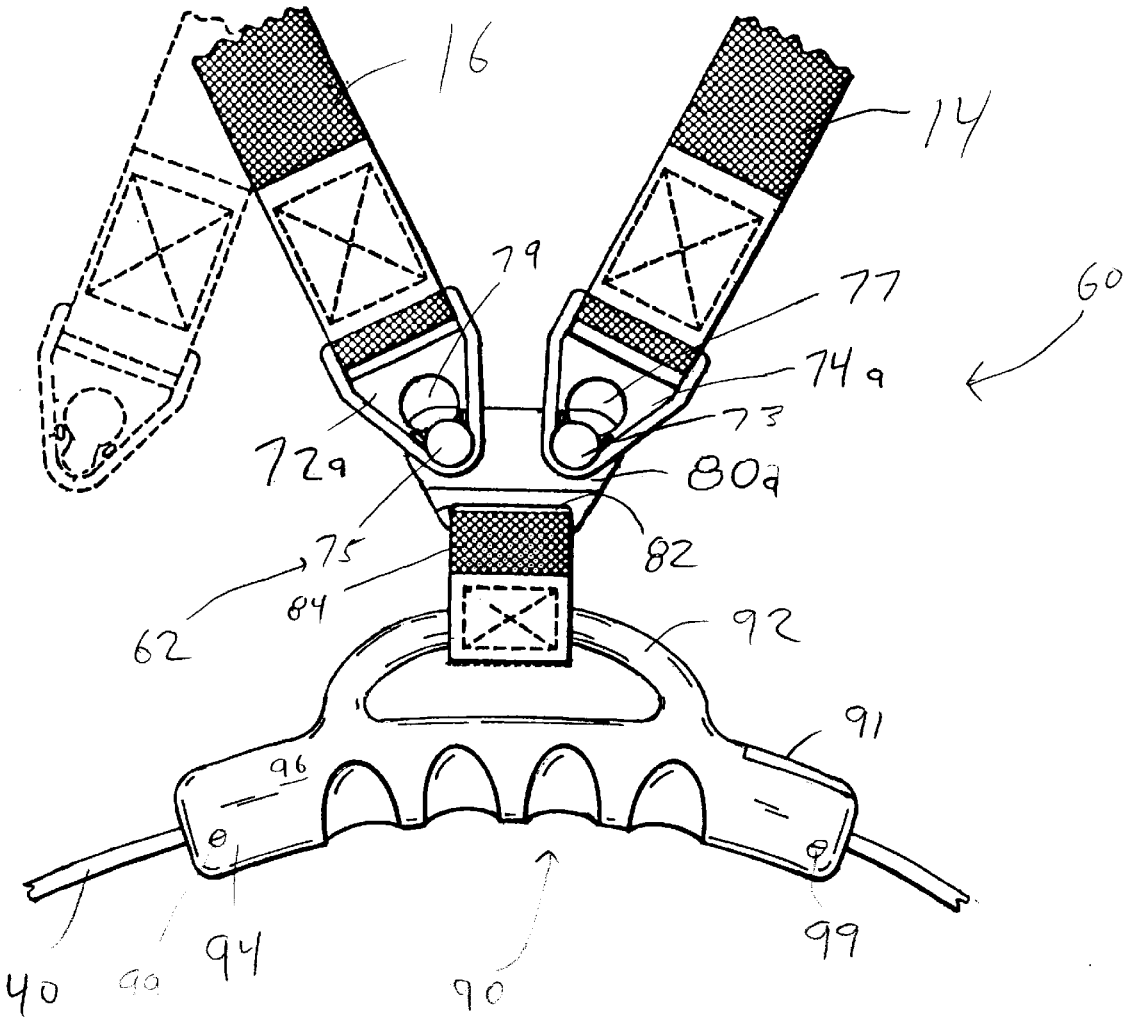
FIG. 5 is a front elevation view of another embodiment of the present invention.
Figure 6:
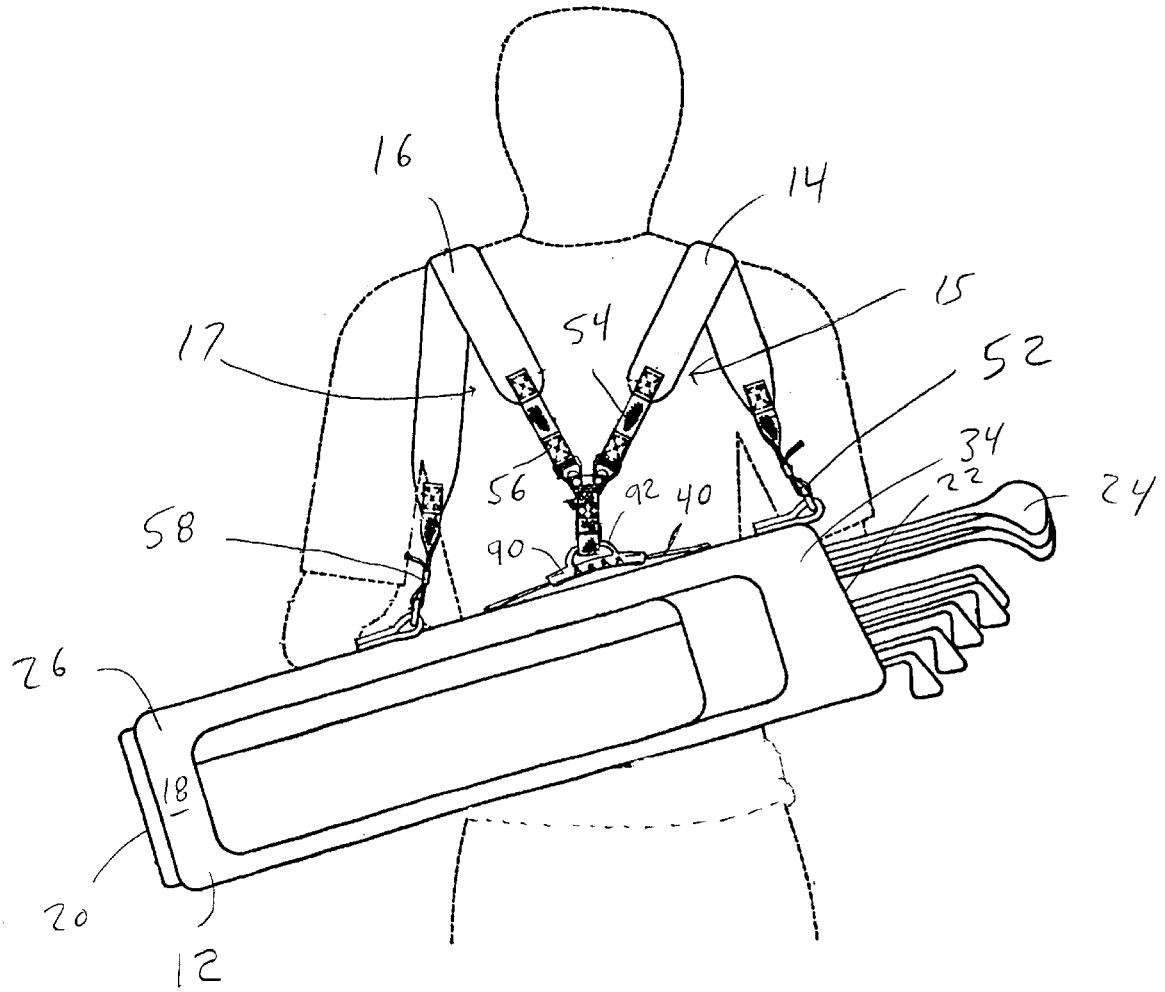
FIG. 6 is a rear view in elevation of a person carrying a golf bag utilizing the present invention.

As is best shown in FIGS. 4 and 5, first strap 14 and second strap 16 are mounted to golf bag 12 by means of the attachment assembly 60. The ends 54 and 56 of straps 14 and 16 ends are attached adjacent one another to form a central portion 62 of the attachment assembly 60 and connection to golf bag handle 40 is accomplished by means of a unique handle assembly described below in greater detail.

Figure 3:
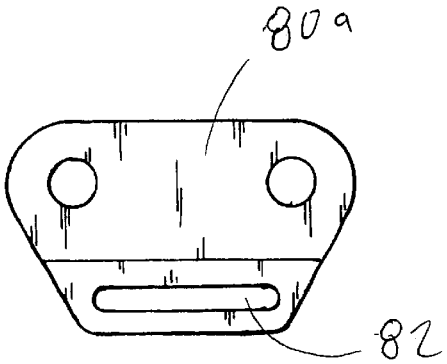
FIG. 3 is a front view in elevation of one embodiment of the central mounting element of the present invention.

As shown in FIGS. 3 through 5, the handle assembly includes a central mounting element 80 (80*a* in FIGS. 3 and 5). The central mounting element 80 and 80*a* may be formed in various shapes and from various materials. The ends 54 and 56 of straps 14 and 16 are connected to the central mounting element 80 preferably by swivel connectors 72 and 74(FIG. 4). The swivel connectors 72 and 74 are preferably of the type disclosed in U.S. Pat. No. 6,006,974, the disclosure of which is hereby incorporated by reference. FIG. 5 shows an embodiment in which swivel connectors 72*a* and 74*a* are removable by slipping pivots 73 and 75 through key holes 77 and 79. The central mounting element 80 or 80*a* includes a slot 82 for receiving a mounting strap 84. The strap 84 forms a loop, one end 86 of which extends through the slot 82 and the other end 88 of which is connected to the handle casing 90. Preferably, the strap 84 includes a tab 87 (FIG. 4) at one end which removably connects the strap 84 to the central mounting element 80. To separate the strap 84 from the central mounting element 80, the tab 87 is inserted back through the slot 82 so that the central mounting element 80 is no longer connected to the golf bag 12.

Figure 7:
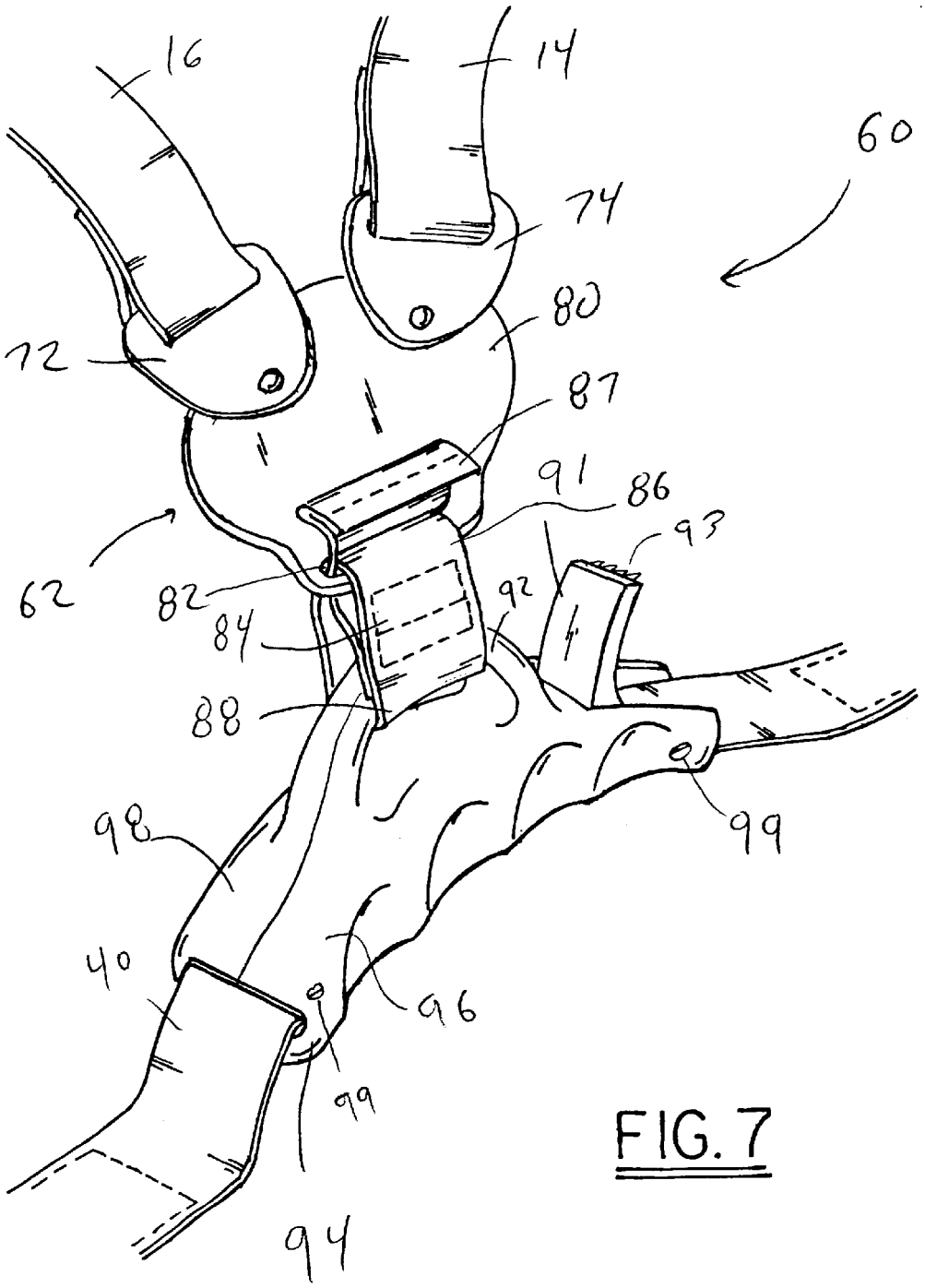
FIG. 7 is a perspective view of the handle casing showing the locking lever in the open position.

The handle casing 90 includes an attachment member or ring 92 integral with the handle portion 94. The strap 84 is connected to the attachment member 92. The handle portion 94 of the handle casing 90 is preferably constructed in two half sections 96 and 98 which are connected to one another through conventional means such as screws 99. Alternatively, bolts, rivets, or other connection means may be used. By removing the screws 99, the two half sections 96 and 98 may be separated to remove the handle casing 90 from the golf bag handle 40. The handle casing 90 includes a locking lever 91 which may be rotated from a locked position (FIG. 4) to an unlocked position (FIG. 7). In the unlocked position, the teeth 93 are disengaged from the handle 40 so that the handle casing 90 may be moved along the golf bag handle 40 to adjust the position of the handle casing 90, and, thus, the ends 54 and 56 of the straps 14 and 16 with respect to the golf bag 12. This adjustment changes the balance point of the golf bag 12 to optimize the comfort of the wearer of the golf bag 12.

It may be seen from the foregoing that first strap 14 is secured at a first location proximate the open end 22 of golf bag 12 and at a second location longitudinally spaced from the first location so that first strap 14 defines a first strap opening 15 sized to accommodate one of the shoulders of a person who carries golf bag 12. Second strap 16 has a first end 56 thus secured to the golf bag at the second location and has a second end 58 secured at a third location longitudinally spaced from the second location between the second location and closed end 20 to define a second strap opening 17 sized to receive the other shoulder of the person who carries golf bag 12. Accordingly, a person may carry the golf bag by inserting both arms respectively through strap openings 15 and 17 so that the golf bag 12 may be supported by the shoulders and suspended transversely across the back, as is shown in the right hand orientation of FIG. 6. It should be understood, however, that the golf bag could be carried with the club heads projecting to the left, that is, in a left hand orientation opposite that orientation, shown in FIG. 6 with the structure described herein reversed as would be evident to the ordinarily skilled person in this field of invention.

It may be seen that handle casing 90 also provides a convenient "one-handed" lift for golf bag 12 when the golf bag is not worn on the shoulders. Further, for carrying golf bag 12 a short distance, it is sometimes desirable that a single carrying strap be used. To this end, first strap 14 provides a primary carrying strap that may be placed over one of the person's shoulders and strap 16 is left in a dangling state.

From the foregoing, it may also be readily appreciated that different attachment structures can be provided for mounting straps 14 and 16 and that the strap can be provided with other mounting strap constructions, as would now be recognized by the ordinarily skilled person in this field of endeavor.

Accordingly, the present invention has been described with some degree of particularly directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

What is claimed is:

1. In a golf bag having two shoulder straps, each having first and second ends, the first ends attached to the golf bag, the second ends attached to a central mounting element, the improvement comprising:

a handle having first and second ends, the first and second ends attached to the golf bag;

a handle casing slidably having a handle portion, the handle casing disposed on the handle such that the position of the handle casing may be adjusted relative to the first and second ends of the handle;

an attachment member integral with the handle casing; and an attachment means for connecting the attachment member to the central mounting element.

2. The apparatus of claim 1 further including locking means for fixing the position of the handle casing with respect to the handle.

3. The apparatus of claim 2 wherein the locking means includes a lever member rotatably attached to the handle casing and having a first position wherein the lever member contacts the handle and a second position wherein the lever member is spaced away from the handle.

4. The apparatus of claim 1 wherein the handle casing comprises two sections attached to one another.

5. The apparatus of claim 4 wherein the two sections are releasably attached to one another.

6. The apparatus of claim 5 wherein the two sections are releasably attached by means of screw fasteners.

7. The apparatus of claim 1 wherein the shoulder straps are pivotally attached to the central mounting element.

8. The apparatus of claim 1 wherein the shoulder straps are removably attached to the central mounting element.

9. The apparatus of claim 1 wherein the attachment means includes an attachment strap connected between the attachment member and the central mounting element.

10. The apparatus of claim 9 wherein the attachment strap is removably attached to the central mounting element.

11. The apparatus of claim 1 wherein the attachment member includes a semicircular ring integral with the handle casing.

12. The apparatus of claim 1 wherein the handle casing is constructed of acetal.

* * * * *